US009323263B2

(12) United States Patent
Jain et al.

(10) Patent No.: US 9,323,263 B2
(45) Date of Patent: Apr. 26, 2016

(54) LOW DROPOUT REGULATOR WITH HYSTERETIC CONTROL

(71) Applicants: Rinkle Jain, Portland, OR (US); Yi-Chun Shih, Hillsboro, OR (US); Vaibhav Vaidya, Portland, OR (US)

(72) Inventors: Rinkle Jain, Portland, OR (US); Yi-Chun Shih, Hillsboro, OR (US); Vaibhav Vaidya, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 96 days.

(21) Appl. No.: 13/626,366

(22) Filed: Sep. 25, 2012

(65) Prior Publication Data

US 2014/0084881 A1 Mar. 27, 2014

(51) Int. Cl.
*G05F 1/00* (2006.01)
*G05F 1/565* (2006.01)

(52) U.S. Cl.
CPC ..... *G05F 1/565* (2013.01)

(58) Field of Classification Search
CPC ..... G05F 1/56; G05F 1/565; G05F 1/569; G05F 1/573; G05F 1/575; H02M 3/156
USPC ..... 323/273–275, 279–280
See application file for complete search history.

(56) References Cited

U.S. PATENT DOCUMENTS 7,385,376 B2 * 6/2008 Zolfaghari ..... 323/266
7,495,506 B1 * 2/2009 Carper ..... 327/540
7,554,306 B2 * 6/2009 Lee et al. ..... 323/273
7,893,672 B2 * 2/2011 Scoones et al. ..... 323/280
8,044,646 B2 * 10/2011 Ozalevli et al. ..... 323/274
2008/0265854 A1 10/2008 Lee et al.
2009/0322295 A1 12/2009 Scoones et al.
2010/0308890 A1 12/2010 Schlueter et al.
2011/0089916 A1 4/2011 Soenen et al.
2011/0227552 A1 * 9/2011 Hu et al. ..... 323/304
2011/0249492 A1 * 10/2011 Kumazaki et al. ..... 365/185.2

(Continued)

FOREIGN PATENT DOCUMENTS

TW 1257036 6/2006
TW 1330308 9/2010

(Continued)

OTHER PUBLICATIONS

Notification of Transmittal of the International Search Report and the Written Opinion of the International Searching Authority issued for International Patent Application No. PCT/US2013/045016, mailed Nov. 12, 2013, 11 pages.

(Continued)

*Primary Examiner* — Gary L Laxton
*Assistant Examiner* — Kevin H Sprenger
(74) *Attorney, Agent, or Firm* — Blakely, Sokoloff, Taylor & Zafman LLP

(57) ABSTRACT

An output stage has an input supply node to receive an input power supply and an output node to provide an output supply to a load. An amplifier is used to control current strength of the output stage according to the output supply and a reference voltage. A hysteresis unit is used to monitor the output supply and operable to control the current strength of the output stage according to a voltage level of the output supply. In one embodiment, a plurality of charge pumps are used to adjust current strength of the output stage. A logic unit is used to monitor the output supply and operable to control the plurality of charge pumps according to a voltage level of the output supply and one or more reference voltages.

29 Claims, 11 Drawing Sheets

(56) References Cited

U.S. PATENT DOCUMENTS

| | | | | |
|---|---|---|---|---|
| 2012/0105047 | A1 | 5/2012 | Huang et al. | |
| 2012/0155144 | A1 | 6/2012 | Xia et al. | |
| 2012/0187927 | A1 | 7/2012 | Yu et al. | |
| 2012/0187930 | A1 * | 7/2012 | Williams et al. | 323/273 |

FOREIGN PATENT DOCUMENTS

| | | | |
|---|---|---|---|
| TW | 201122755 | A | 7/2011 |
| TW | 1363264 | | 5/2012 |

OTHER PUBLICATIONS

First Notification to Make Rectification issued for Chinese Patent Application No. 201320598466.7, mailed Jan. 9, 2014, 4 pages.

An Official Letter from related Taiwan Application No. 102131655, dated Nov. 6, 2014, including Search Report of R.O.C. in English. 12 pages total.

Taiwan (R.O.C.) Patent Application No. 102131655, Notice of Allowance mailed Oct. 6, 2015, (with English translation) 3 pages.

Taiwan (R.O.C.) Patent Application No. 102131655, Allowed Claims mailed Oct. 6, 2015, (with English translation) 46 pages.

An Official Letter from related Taiwan Application No. 102131655, mailed May 11, 2015, including Search Report of R.O.C. in English. 7 pages total.

Notification Concerning Transmittal of Copy of International Preliminary Report on Patentability (Chapter 1 of the Patent Cooperation Treaty), date of mailing Apr. 9, 2015, 2 pages.

* cited by examiner

Gate Control Charge Pump

LOW DROPOUT REGULATOR WITH HYSTERETIC CONTROL

BACKGROUND

Typical low dropout (LDO) regulator has analog control and slow response. The minimum dropout of the LDO regulator is limited by the pass gate in saturation, yielding reduced output range, maximum efficiency achievable, and may suffer from stability issues during fast power state changes. For example, when power state shifts from an idle state to a wakeup state, stability issues may arise. Typical LDO regulator also exhibits good efficiency at conversion ratios close to one. Switched Capacitor Voltage Regulators (SCVRs) on the other hand exhibit high efficiency across wide range of output voltage and currents. SCVRs also exhibit response times in the order of few nanoseconds, making them great candidates for dynamic voltage and frequency scaling (DVFS). However, SCVR show limited current supplying capabilities per unit area determined by a capacitor.

BRIEF DESCRIPTION OF THE DRAWINGS

Embodiments of the disclosure will be understood more fully from the detailed description given below and from the accompanying drawings of various embodiments of the disclosure, which, however, should not be taken to limit the disclosure to the specific embodiments, but are for explanation and understanding only.

DETAILED DESCRIPTION

Figure 1:
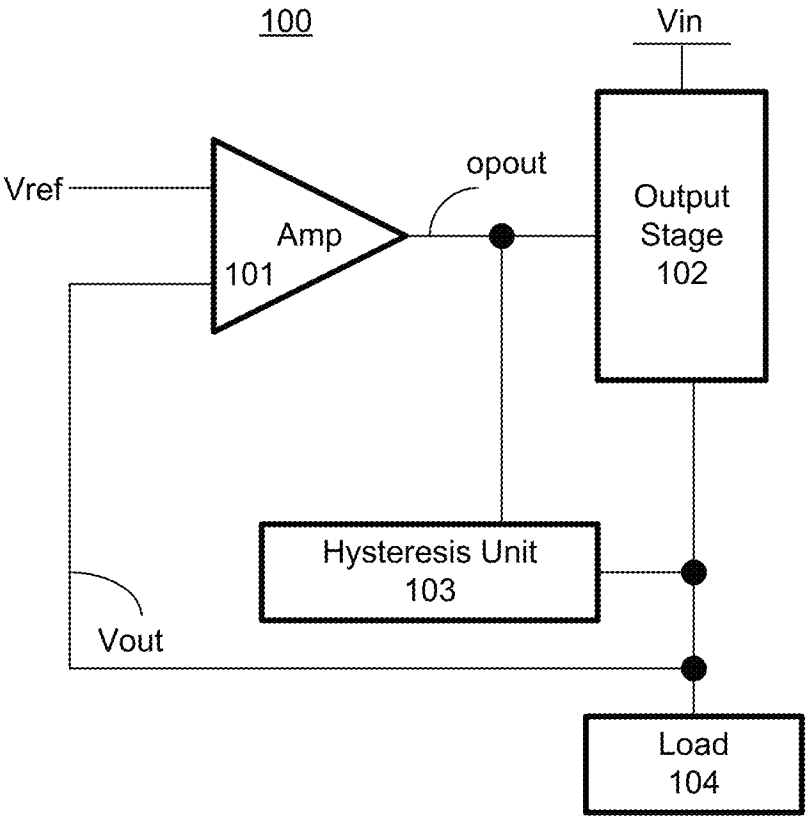
FIG. 1 is a low dropout (LDO) regulator with hysteresis unit, according to one embodiment of the disclosure.

The embodiments herein describe an embedded LDO within an SCVR that allows conversion of an SCVR to an LDO. In some embodiments, a hysteresis control is introduced to allow using a lower bandwidth amplifier to reduce power consumption, and at the same time enhance response time. For example, the hysteresis control provides for digital control of the LDO when the output voltage from the LDO overshoots or undershoots relative to a predetermined level. The LDO discussed herein may generate ultra-fast response time, with 99% current efficiency.

The embodiments discussed herein also enable an LDO to have SCVR like response times, and eliminates or reduces stability issues. In one embodiment, the LDO extends the VR current capability when enabled within SCVR in wide output applications. In such an embodiment, the LDO embedded in the SCVR provides better efficiency (than an SCVR without an embedded LDO), better usability range of voltage, higher speed and improved stability in applications where output electrical characteristics are close to input electrical characteristics.

The embodiments herein apply digital control to enhance control speed of signals compared to analog signals. The digital control scheme also allows for scaling of the design across process technologies. Other technical effects will be evident from various embodiments discussed herein.

The term "scaling" herein refers to converting a design (schematic and layout) from one process technology to another process technology.

In the following description, numerous details are discussed to provide a more thorough explanation of embodiments of the present disclosure. It will be apparent, however, to one skilled in the art, that embodiments of the present disclosure may be practiced without these specific details. In other instances, well-known structures and devices are shown in block diagram form, rather than in detail, in order to avoid obscuring embodiments of the present disclosure.

Note that in the corresponding drawings of the embodiments, signals are represented with lines. Some lines may be thicker, to indicate more constituent signal paths, and/or have arrows at one or more ends, to indicate primary information flow direction. Such indications are not intended to be limiting. Rather, the lines are used in connection with one or more exemplary embodiments to facilitate easier understanding of a circuit or a logical unit. Any represented signal, as dictated by design needs or preferences, may actually comprise one or more signals that may travel in either direction and may be implemented with any suitable type of signal scheme.

Throughout the specification, and in the claims, the term "connected" means a direct electrical connection between the things that are connected, without any intermediary devices. The term "coupled" means either a direct electrical connection between the things that are connected, or an indirect connection through one or more passive or active intermediary devices. The term "circuit" means one or more passive and/or active components that are arranged to cooperate with one another to provide a desired function. The term "signal" means at least one current signal, voltage signal or data/clock signal. The meaning of "a", "an", and "the" include plural references. The meaning of "in" includes "in" and "on." The terms "substantially," "close," "approximately," herein refer to being within +/−20% of a target value.

As used herein, unless otherwise specified the use of the ordinal adjectives "first," "second," and "third," etc., to describe a common object, merely indicate that different instances of like objects are being referred to, and are not intended to imply that the objects so described must be in a given sequence, either temporally, spatially, in ranking or in any other manner.

For purposes of the embodiments described herein, the transistors are metal oxide semiconductor (MOS) transistors, which include drain, source, gate, and bulk terminals. Source and drain terminals may be identical terminals and are interchangeably used herein. Those skilled in the art will appreciate that other transistors, for example, Bi-polar junction transistors—BJT PNP/NPN, BiCMOS, CMOS, eFET, etc., may be used without departing from the scope of the disclosure. The terms "MN" herein indicates an n-type transistor (e.g., NMOS, NPN BJT, etc) and the term "MP" indicates a p-type transistor (e.g., PMOS, PNP BJT, etc).

FIG. 1 is an LDO regulator 100 with hysteresis unit, according to one embodiment of the disclosure. In one embodiment, LDO regulator 100 comprises an amplifier (also called an error amplifier) 101, an output stage 102, and a hysteresis unit 103. In one embodiment, LDO 100 provides a regulated output voltage Vout to a load 104, where Vout is a regulated version of the input voltage Vin.

In one embodiment, the load 104 is a processor core. In one embodiment, the load 104 is a cache/memory. In one embodiment, the load 104 is any logic portion of the processor core. In other embodiments, load 104 is a group of logic units in a voltage domain that operate on the same power supply level. For example, a group of logic units are input-output (I/O) buffers of the processor (not shown).

In one embodiment, amplifier 101 drives a gate terminal of a transistor (not shown) of the output stage 102 which receives an input power supply Vin and provides a regulated voltage Vout to the load 104. In one embodiment, output power supply Vout, or its divided version (e.g., Vout/2) is compared with a reference voltage Vref by the amplifier 101.

In one embodiment, Vref is generated by a bias circuit (not shown). For example, Vref is generated by a bandgap reference circuit. In another example, Vref is generated by a resistor voltage divider. In another example, Vref is generated externally from the processor and routed inside the processor via a pin. In other embodiments, Vref may be generated by other sources.

This negative feedback sets the voltage of the gate terminal of M1 so that Vout is substantially equal to Vref. In one embodiment, hysteresis unit 103 monitors the output voltage Vout to determine whether Vout is undershooting or overshooting relative to a predetermined reference level. In one embodiment, the predetermined reference level is "Vref+delta" (e.g., Vref+20 mv) for determining an overshoot. In one embodiment, the predetermined reference level for determining undershoot is "Vref−delta" (e.g., Vref−20 mV).

The LDO regulation is manifested when the load current changes (e.g., because the demand for current increased by the load 104) which in turn causes the voltage Vout to lower its previous value. A lower level of Vout causes the amplifier 101 to turn on the output stage transistor (not shown) harder to raise the level of Vout to be substantially equal to Vref, and thus regulating Vout. In one embodiment, when Vout undershoots below "Vref−delta," then the hysteresis unit 103 adjusts the output opout of the amplifier 101 to cause the output stage 102 to raise the voltage level of Vout. In one embodiment, when Vout overshoots below "Vref+delta," then the hysteresis unit 103 adjusts the output opout of the amplifier 101 to cause the output stage 102 to decrease the voltage level of Vout. In such an embodiment, the hysteresis unit 103 allows the design of the amplifier 101 to relax (i.e., the amplifier 101 may not need a fast response time) because the hysteresis unit 103 is performing part of the regulation of Vout.

Figure 2:
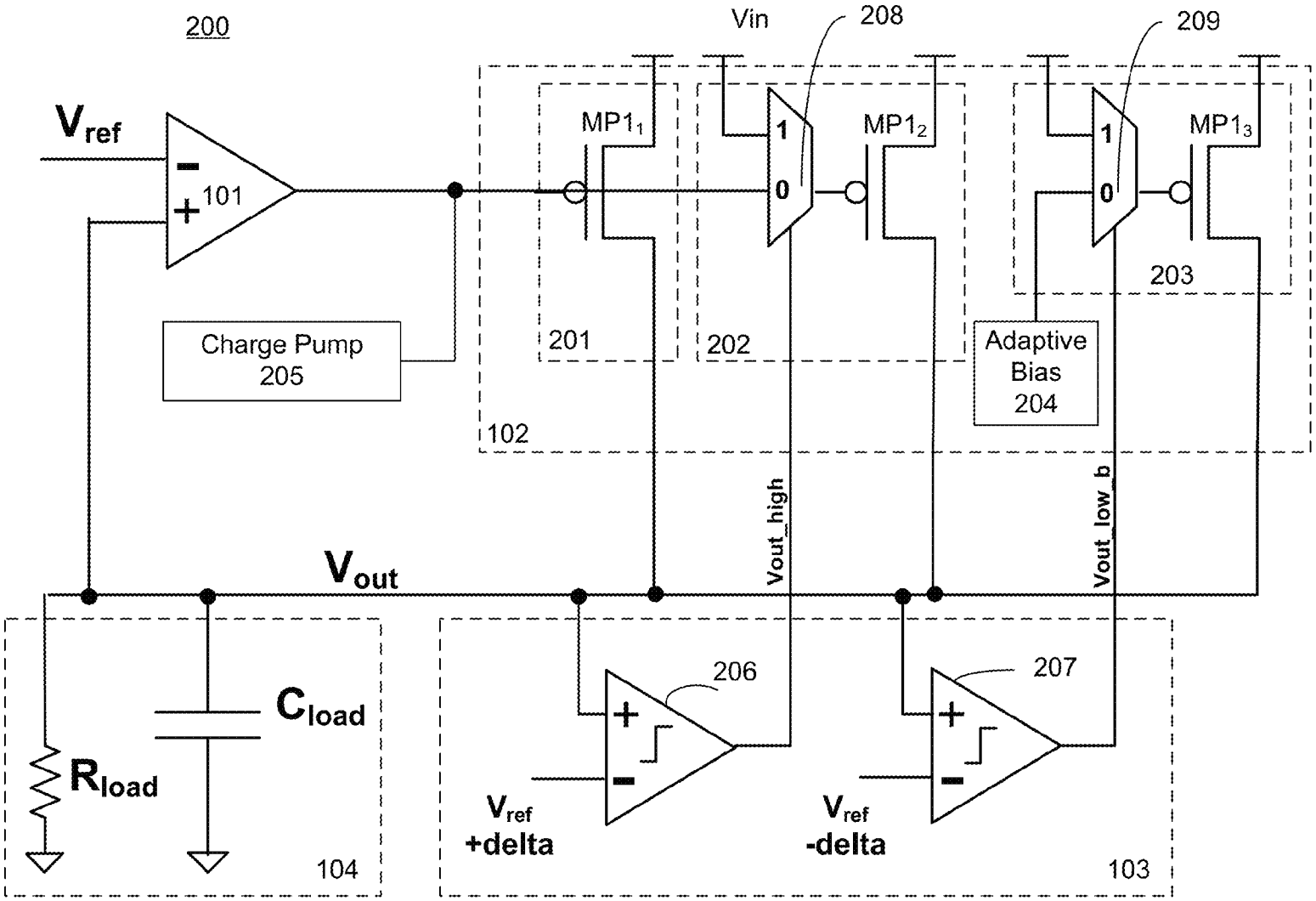
FIG. 2 is a detailed view of the LDO regulator with the hysteresis unit, according to one embodiment of the disclosure.

FIG. 2 is a detailed view of the LDO regulator 200 with the hysteresis unit 103, according to one embodiment of the disclosure. FIG. 2 is described with reference to FIG. 1.

In one embodiment, LDO regulator 200 comprises an output stage (e.g., 102 of FIG. 1) having one or more output stages to provide regulated power supply Vout to the load 104. In the embodiments discussed herein the load 104 is represented as a lumped RC network comprising a load resistor $R_{load}$ in parallel to the load capacitor $C_{load}$. However, the load 104 may comprise a distributed RC network.

In one embodiment, output stage 102 comprises a first stage 201 coupled to the amplifier 101; a second stage 202 operable to be selectively turned on or off by the hysteresis unit 102; and a third stage 203 operable to be selectively turned on or off by the hysteresis unit 102.

In one embodiment, first stage 201 comprises a p-type transistor $MP1_1$ with its gate terminal coupled to the output of the amplifier 101, its drain terminal coupled to the output supply node Vout and its source terminal coupled to the input supply node having supply Vin. In this embodiment, the first stage 201 is normally turned on i.e., $MP1_1$ is conducting.

In one embodiment, second stage 202 comprises a p-type transistor $MP1_2$ with its source and drain terminals coupled to the input supply node Vin and the output supply node Vout respectively. In one embodiment, gate terminal of $MP1_2$ is operable to be coupled to the output of the amplifier 101 or the input supply node Vin via a first selection unit 208. In one embodiment, first selection unit 208 is controlled by the hysteresis unit 103. In one embodiment, first selection unit 208 is a multiplexer with a select input controlled by the hysteresis unit 103. In one embodiment, second stage 202 provides overshoot protection to the node Vout and is normally turned on i.e., the p-type transistor $MP1_2$ is normally turned on and is turned off by the hysteresis unit 103 if overshoot is detected on the node Vout.

In one embodiment, third stage 203 comprises a p-type transistor $MP1_3$ with its source and drain terminals coupled to the input supply node Vin and the output supply node Vout respectively. In one embodiment, gate terminal of $MP1_3$ is operable to be coupled to the output of a bias circuit 204 (also called adaptive bias circuit) or the input supply node Vin via a second selection unit 209. In one embodiment, second selection unit 209 is controlled by the hysteresis unit 103. In one embodiment, second selection unit 209 is a multiplexer with a select input controlled by the hysteresis unit 103. In one embodiment, third stage 203 provides undershoot protection to the node Vout and is normally turned off i.e., the p-type transistor $MP1_3$ is normally turned off and is turned on by the hysteresis unit 103 if undershoot is detected on the node Vout.

In one embodiment, hysteresis unit 103 comprises a first comparator or amplifier 206 and a second comparator or amplifier 207. In one embodiment, first comparator 206 generates the control signal for the first selection unit 208. In this embodiment, first comparator 206 compares the output voltage Vout with "Vref+delta" to determine when to turn off $MP1_2$. Here, Vref is the reference voltage level provided to the amplifier 101 which generates the control voltage for $MP1_1$ and $MP1_2$ to regulate Vout. In one embodiment, "delta" is 20 mV. In other embodiments, other values of "delta" may be used to determine when to turn off $MP1_2$ when overshoot occurs on Vout.

For example, when Vout overshoots i.e., Vout rises suddenly above a predetermined level over the steady state (i.e., regulated) Vout level, then the first comparator 206 generates an output which causes the first selection unit 208 to select Vin as input to the gate terminal of $MP1_2$. In such an embodiment, $MP1_2$ is turned off during the overshoot period. Once the overshoot subsides because $MP1_2$ is no longer providing extra charge to the node Vout, then $MP1_2$ is turned on by the first comparator 206 when Vout falls below "Vref+delta."

In one embodiment, second comparator 207 generates the control signal for the second selection unit 209. In this embodiment, second comparator 207 compares the output voltage Vout with "Vref−delta" to determine when to turn on $MP1_3$. Here, Vref is the reference voltage level provided to the amplifier 101 which generates the control voltage for $MP1_1$ and $MP1_2$ to regulate Vout. In one embodiment, "delta" is 20 mV. In other embodiments, other values of "delta" may be used to determine when to turn on $MP1_3$ when undershoot occurs on Vout.

For example, when Vout undershoots i.e., Vout falls suddenly below a predetermined level over the steady state (i.e., regulated) Vout level, then the second comparator 207 generates an output which causes the second selection unit 209 to select a bias voltage from the bias circuit 204. In one embodiment, bias voltage from the bias circuit 204 is provided as input to the gate terminal of $MP1_3$ to turn on $MP1_3$ to cause Vout to rise back to its steady state level. In such an embodiment, $MP1_3$ is turned on during undershoot period. Once undershoot subsides because $MP1_3$ provides extra charge to the node Vout, then $MP1_3$ is turned off by the second comparator 207 when Vout rises above "Vref–delta." In such an embodiment, the output of the second comparator 207 causes the second selection unit 209 to select Vin as input to $MP1_3$ to cause it to turn off.

In one embodiment, first and second comparators 206 and 207 are clocked comparators. For example, first and second comparators 206 and 207 generate an output on a transition event of a clock signal received by the first and second comparators 206 and 207. In other embodiments, outputs of the first and second comparators 206 and 207 are asynchronous outputs i.e., not aligned to clock signal transitions.

In one embodiment, bias circuit 204 generates a bias signal for adjusting the current strength of $MP1_3$. For example, the bias circuit 204 generates a charging current for adjusting current strength of $MP1_3$, wherein the bias circuit is operable to adjust the charging current according to the reference voltage Vref. In one embodiment, bias circuit 204 comprises a replica regulator including an amplifier (like amplifier 101), an output stage (like $MP1_1$), and a feedback path (like Vout).

Figure 4:
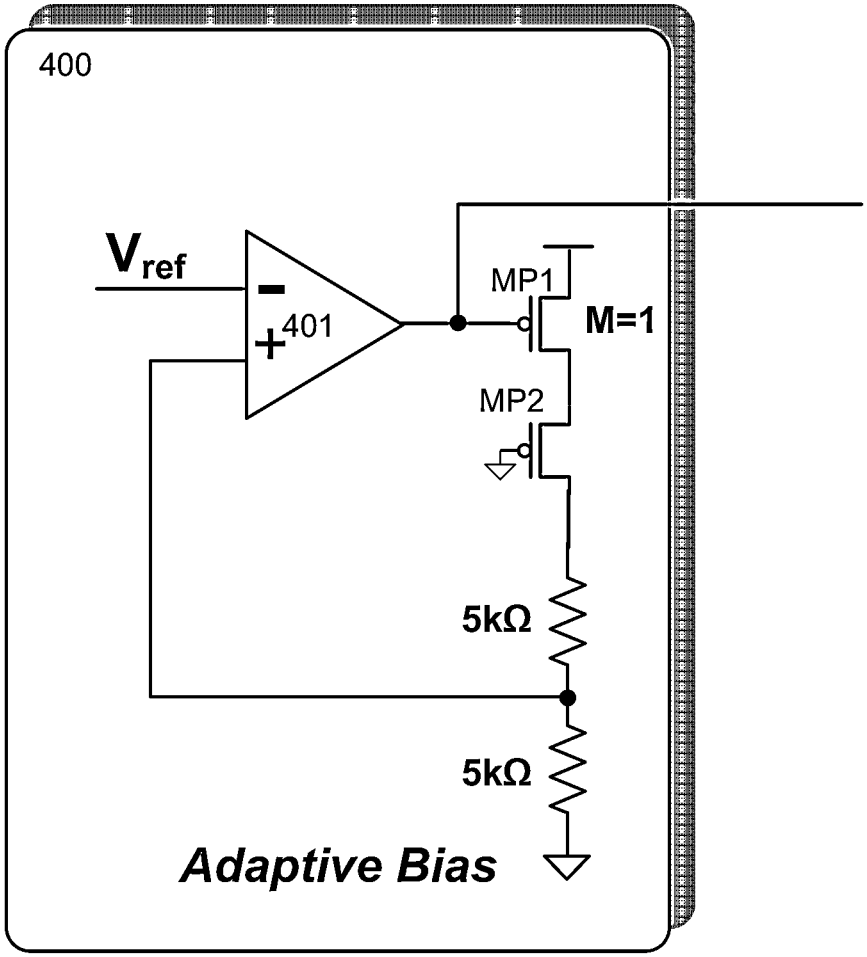
FIG. 4 is an adaptive bias unit of the LDO regulator, according to one embodiment of the disclosure.

FIG. 4 is an adaptive bias unit 400 (e.g., bias circuit 204), according to one embodiment of the disclosure. In this embodiment, adaptive bias unit 400 is a replica regulator comprising amplifier 401 (same as amplifier 101 of FIG. 1), output stage transistor MP1 (same as $MP1_1$ of FIG. 2), and a feedback network coupling MP1 to an input of the amplifier 401. In one embodiment, output of the amplifier 401 is used as input to the second selector unit 209. In one embodiment, adaptive bias unit 400 behaves as part of a current mirror, where the current through MP1 of adaptive bias unit 400 is mirrored on $MP1_3$ of the third stage 203. For example, when $MP1_3$ is 60 times larger in width than MP1 of adaptive bias unit 400, then the output voltage of the amplifier 401 which is received by the gate terminal of $MP1_3$ of the third stage 203 via the second selection unit 203, larger current flows through $MP1_3$ which allows $MP1_3$ to cancel the effect of undershoot on Vout.

In one embodiment, adaptive bias unit 400 comprises another p-type transistor MP2 coupled in series with MP1, where MP2 is always turned on. In one embodiment, MP2 is a replica transistor for the $MP2_3$ in FIG. 6. For a stand-alone LDO as the one in FIG. 2, this MP2 is not needed. In one embodiment, the feedback path is coupled from a resistor divider network which is coupled to MP2 as shown. In one embodiment the resistors are 5 KΩs. In other embodiments, other values of resistors may be used.

Referring back to FIG. 2, in one embodiment LDO 200 comprises a charge pump 205 which is coupled to an output of the amplifier 101. In one embodiment, charge pump 205 is operable to adjust a voltage level of the output of the amplifier 101. For example, the charge pump 205 adds charge to the output of the amplifier 101 when the output supply Vout overshoots relative to a first predetermined threshold. In one embodiment, charge pump 205 is operable to subtract charge from the output of the amplifier 101 when the output supply Vout undershoots relative to a second predetermined threshold. In one embodiment, the second predetermined threshold is different from the first predetermined threshold. For example, the second predetermined threshold is "Vref–delta" and the first predetermined threshold is "Vref+delta."

In one embodiment, charge pump 205 accelerates the settling of the output of the amplifier 101 when Vout is outside the boundaries of the first and second predetermined thresholds. For example, charge pump 205 is activated when Vout is greater than "Vref+delta" or less than "Vref–delta." In one embodiment, charge pump 205 is not activated when Vout is within the boundaries of the first and second predetermined thresholds. For example, charge pump 205 is deactivated when Vout is less than "Vref+delta" and greater than "Vref–delta." In such an embodiment, charge pump 205 does not affect the stability of the LDO 200.

Figure 3A:
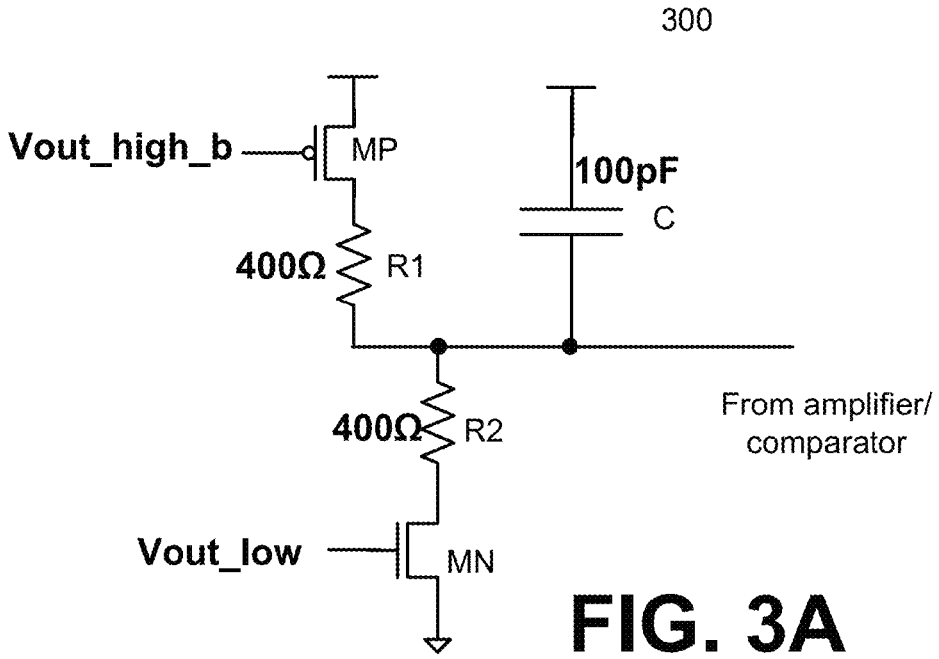
FIGS. 3A-B illustrate a charge pump of the LDO regulator, according to one embodiment of the disclosure.
Figure 3B:
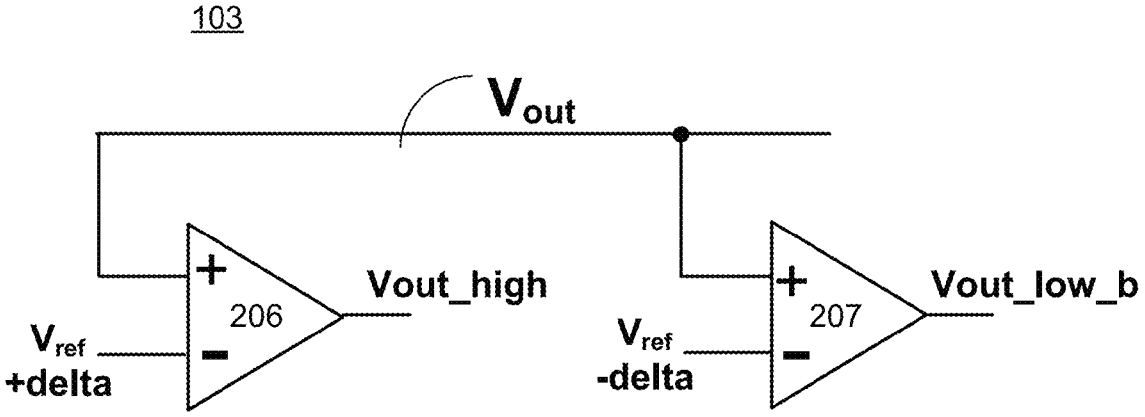

FIG. 3A illustrates a charge pump 300 (e.g., charge pump 205), according to one embodiment of the disclosure. FIG. 3A is described with reference to FIG. 2 and FIG. 3B which illustrates the hysteresis unit 103 of the LDO regulator 200/100, according to one embodiment of the disclosure. In one embodiment, charge pump 300 comprises a p-type transistor MP, an n-type transistor MN, resistors R1 and R2, and capacitor C.

In one embodiment, MP is coupled to the input power supply Vin and a first terminal of the resistor R1, where the source terminal of MP is coupled to the supply node Vin, the drain terminal of MP is coupled to the first terminal of R1, and the gate terminal of MP is controlled by "Vout_high_b" which is the inverse of the output "Vout_high" of the first comparator 206. Here, "Vout_high_b" indicates an inverse of "Vout_high."

In one embodiment, MN is coupled to ground and a first terminal of the resistor R2, where the source terminal of MN is coupled to ground, the drain terminal of MN is coupled to the first terminal of R2, and the gate terminal of MN is controlled by "Vout_low" which is the inverse of the output "Vout_low_b" of the second comparator 207. In one embodiment, charge pump 300 charges or discharges the output node of the amplifier 101 depending on the outputs of the first and second comparators 206 and 207 respectively. In such an embodiment, charge pump 300 improves the response time of the LDO 200 because the amplifier 101, which is analog in nature, generally takes longer to respond to changes in Vout (caused by, for example, load changes in load 104) under constraints such as loop stability and power budget.

In one embodiment, second terminal of R2 is coupled to the second terminal of R1 as shown, where the second terminals of R2 and R1 provide the output of the charge pump 300. In one embodiment, a capacitor C is added to the output of the charge pump (also the output of the amplifier 101) to provide loop stability across various temperatures and load conditions. In one embodiment, resistors R1 and R2 have resistance of 400 Ωs. In other embodiments, other resistances of resistors R1 and R2 may be used. In one embodiment, the capacitance of capacitor C is 100 pF. In other embodiments, other capacitance values of capacitor C may be used to provide a phase margin for a stable loop (e.g., a phase margin greater than 45 degrees).

Figure 5B:
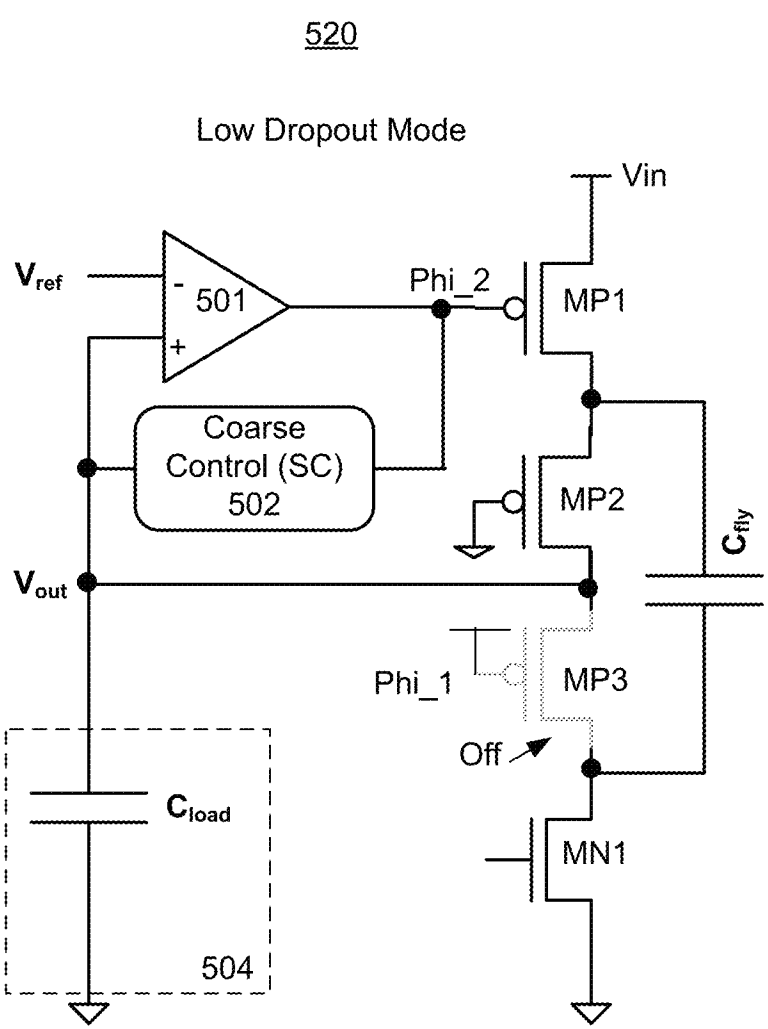
FIG. 5B is an embedded LDO in an SCVR operating in a LDO mode, according to one embodiment of the disclosure.
Figure 5A:
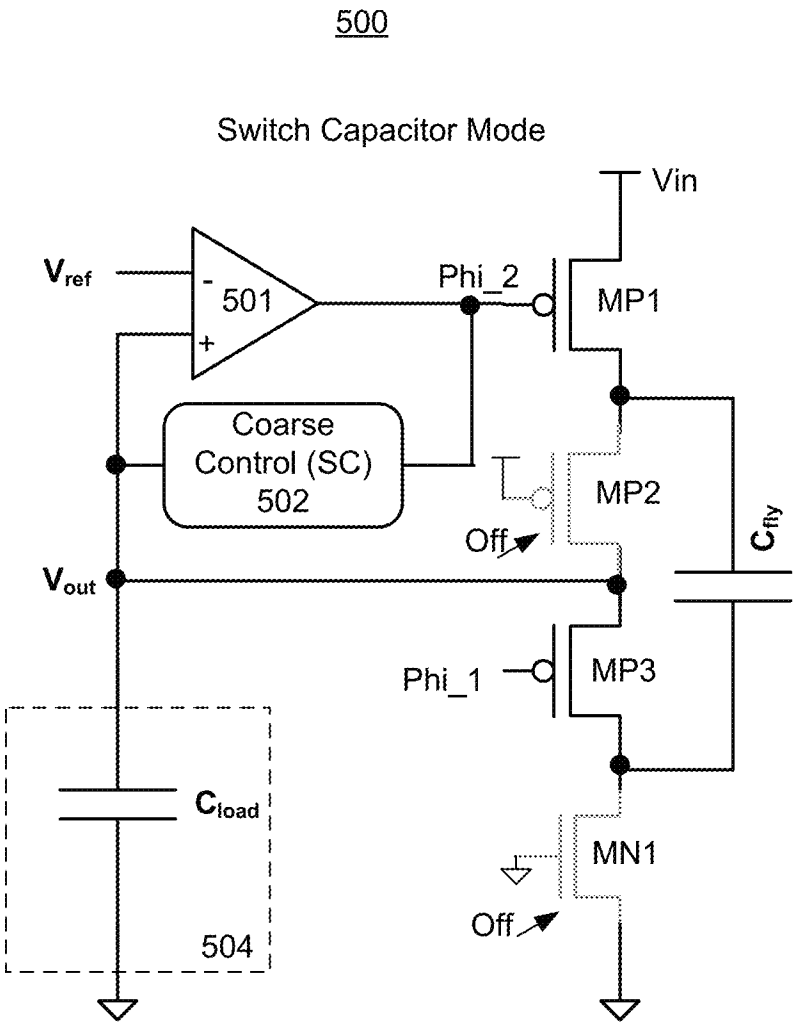
FIG. 5A is an embedded LDO in an SCVR operating in a switch capacitor mode, according to one embodiment of the disclosure.

FIG. 5A is an embedded LDO in an SCVR 500 operating in a switch capacitor mode, according to one embodiment of the disclosure. In one embodiment, embedded LDO in the SCVR 500 comprises amplifier 501 (e.g., same as amplifier 101), p-type transistors MP1, MP2, and MP3, n-type transistor MN1, and fly capacitor $C_{fly}$. In one embodiment, embedded LDO in the SCVR 500 regulates the voltage Vout, based on the input voltage Vin, provided to the load 504.

In one embodiment, embedded LDO in the SCVR 500 also comprises a coarse control unit 502 to provide initial voltage Phi_2 while the amplifier 501 is still determining a response for changing Vout. In one embodiment, in steady state the coarse control unit 502 is deactivated. In one embodiment, coarse control unit 502 is activated when there is a transient changes to Vout caused by, for example, change in load conditions.

In one embodiment, when the embedded LDO in the SCVR 500 is operating in switch capacitor mode, MP2 and MN1 are turned off in a first phase of the SCVR operation. In this embodiment, both Phi_2 and Phi_1 are logically low. In one embodiment, when Phi_2 is logically low, MP1 is turned on and when Phi_1 is logically low, MP3 is turned on causing $C_{fly}$ to store Vin-Vout. In one embodiment, in a second phase of the SCVR operation, Phi_2 and Ph_1 are logically high. In such an embodiment, both MP1 and MP3 are turned off. In one embodiment, during the second phase, MP2 and MN1 are turned on (control circuitry not shown), coupling $C_{fly}$ between ground and Vout nodes. The SCVR toggles between the first and the second phase to provide a 2:1 voltage conversion from Vin to Vout.

FIG. 5B is an embedded LDO in an SCVR 520 operating in a LDO mode, according to one embodiment of the disclosure. So as not to obscure the embodiments of the disclosure, differences between FIG. 5A and FIG. 5B are discussed. FIG. 5B is similar to FIG. 5A except that MP3 is turned off, MP2 is turned on (gate terminal tied to ground or logical low level), and $C_{fly}$ behaves like a decoupling capacitor between the terminals of MP1 and MN1, which causes the circuit topology to operate in LDO mode as opposed to switch capacitor mode. In one embodiment, MN1 may be either turned on or off. For example, when a decoupling capacitor is needed, MN1 is turned on.

Figure 6:
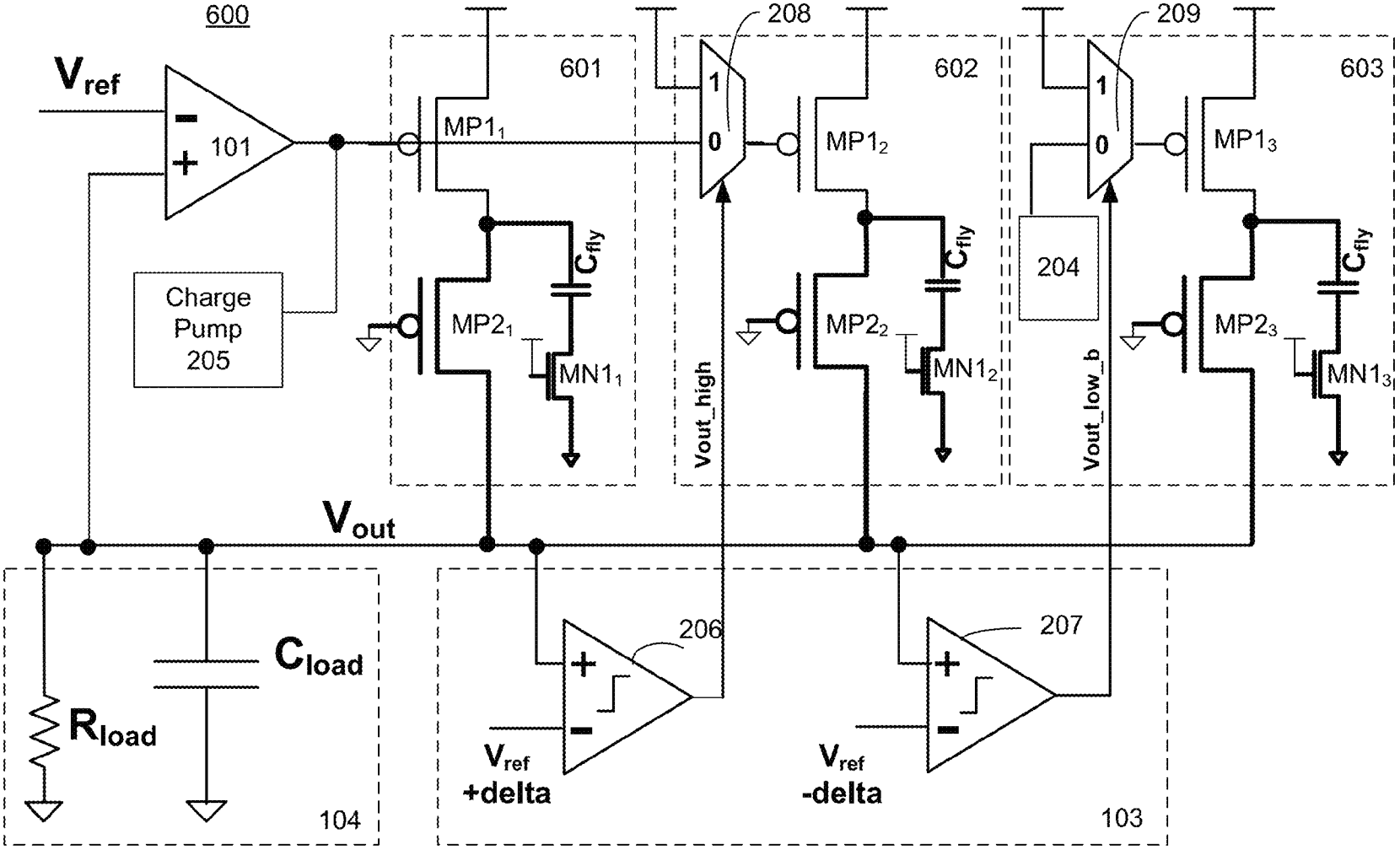
FIG. 6 is a detailed view of an embedded LDO in an SCVR operating in a LDO mode with hysteresis unit, according to one embodiment of the disclosure.

FIG. 6 is a detailed view of an embedded LDO in an SCVR 600 operating in LDO mode with hysteresis unit, according to one embodiment of the disclosure. The embodiment of FIG. 6 is discussed with reference to FIGS. 5A-B. The embodiment of FIG. 6 is similar to the embodiment of FIG. 2 except that the SCVR topology is converted into an LDO. So as not to obscure the embodiments of the disclosure, differences between FIG. 2 and FIG. 6 are discussed.

In one an embodiment, first 601, second 602, and third 603 stages are configured so that MP2 (of FIG. 5A), which are represented as $MP2_1$, $MP2_2$, and $MP2_3$ of the first stage 601, the second stage 602, and the third stage 603 respectively, are turned on. While the embodiment of FIG. 6 shows a ground node coupled to the gate terminals of $MP2_1$, $MP2_2$, and $MP2_3$, a logical signal with a logical low level may be provided to the gate terminals of $MP2_1$, $MP2_2$, and $MP2_3$ to turn the transistors on.

In this embodiment, first 601, second 602, and third 603 stages are configured so that MN1 (of FIG. 5A), which are represented as $MN1_1$, $MN1_2$, and $MN1_3$ of the first stage 601, the second stage 602, and the third stage 603 respectively, are turned on. While the embodiment of FIG. 6 shows a power supply node coupled to the gate terminals of $MN1_1$, $MN1_2$, and $MN1_3$, a logical signal with a logical high level may be provided to the gate terminals of $MN1_1$, $MN1_2$, and $MN1_3$ to turn the transistors on. In this embodiment, the fly capacitor $C_{fly}$ of FIG. 5A operates as a decoupling capacitor between Vout and ground because transistors $MP2_1$, $MP2_2$, and $MP2_3$ and $MN1_1$, $MN1_2$, and $MN1_3$ are turned on. In one embodiment, $MN1_1$-$MN1_3$ can be turned off if capacitor $C_{fly}$ is not needed as decoupling capacitor. In such an embodiment, the functionality of the embedded LDO operating in LDO mode will not be affected.

Figure 7:
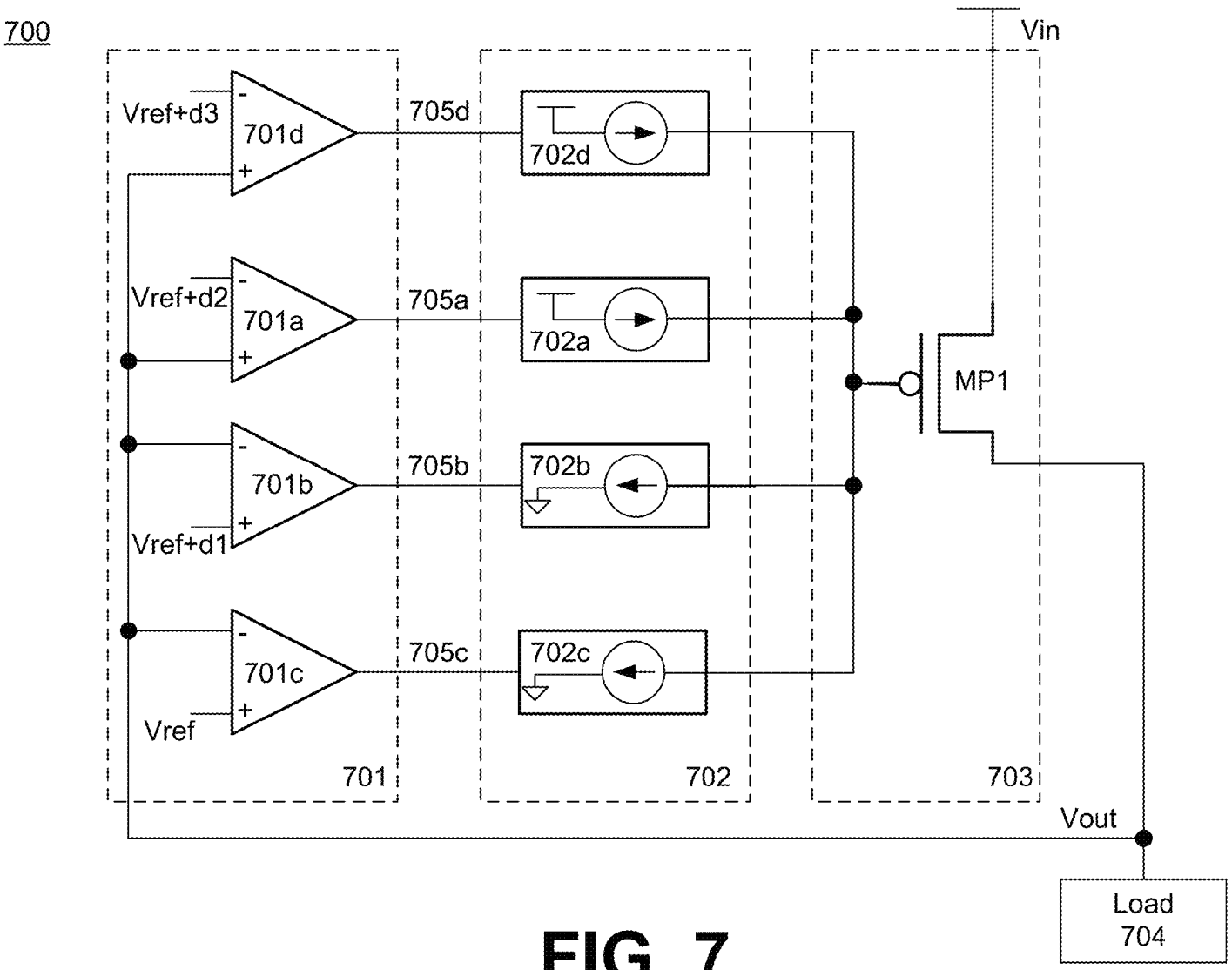
FIG. 7 is an LDO with a plurality of charge pumps, according to one embodiment of the disclosure.

FIG. 7 is an LDO 700 with a plurality of charge pumps, according to one embodiment of the disclosure. In one embodiment, LDO 700 comprises a logic unit 701 including a plurality of comparators/amplifiers 701*a-d*, a charge pump unit including a plurality of charge pumps 702*a-d*, and an output stage 703 providing regulated power supply Vout to the load 704.

In one embodiment, output stage 703 is coupled to an input supply Vin (also called input supply node) and provides a regulated power supply Vout to the load 704. In one embodiment, the input supply Vin is generated off chip and provided to the chip to generated internal power supplied e.g., Vout. In other embodiments, Vin is an internally generated supply (i.e., power supply generated on die).

In one embodiment, output stage 703 comprises a p-type transistor MP1 with its gate terminal coupled to outputs of the plurality of charge pumps 702*a-d*. In such an embodiment, the source terminal of MP1 is coupled to the input supply node Vin, and its drain terminal coupled to the output supply providing Vout to the load 704. In one embodiment, plurality of charge pumps 702*a-d* is capable of adjusting current strength of the output stage 703 to regulate the power supply Vout.

In one embodiment, logic unit 701 monitors the output supply Vout and is operable to control the plurality of charge pumps 702*a-d* according to a voltage level of the output supply Vout and one or more reference voltages—"Vref," "Vref+d1," "Vref+d2," "Vref+d3," where "Vref+d3" is greater than "Vref+d2" which is greater than "Vref+d1" which is greater than "Vref." In one embodiment, "d1" and d3 are 10 mV, and "d3" is 50 mV. In other embodiments, other voltage levels may be used for "d1," "d2," and "d3." In one embodiment, when d1=d2, comparators 701*a* and 701*b* can be combined into a single comparator.

In one embodiment, reference voltages—"Vref," "Vref+d1," "Vref+d2," "Vref+d3"—are generated by a resistor divider network. In other embodiments, the reference voltages are generated by bandgap circuits. In another embodiment, the reference voltages are generated off chip by any reference generator and transmitted to the processor having the LDO 700. In other embodiments, other means for generating the reference voltages may be used.

In one embodiment, logic unit 701 comprises a set of comparators 701*a-d* used for regulating the output voltage Vout within first and second predetermined levels determined by first and second reference voltage levels "Vref+d2" and "Vref+d1," respectively.

In one embodiment, first and second comparators 701*a-b* are coupled to first and second charge pumps 702*a-b* via nodes 705*a* and 705*b* respectively. In one embodiment, first comparator 701*a* causes the first charge pump 702*a*, from the plurality of charge pumps, to reduce drive strength of the output stage 703 when the output supply Vout is greater than the first reference voltage "Vref+d2." In such an embodiment, when the output stage comprises a p-type transistor MP1, the first charge pump 702*a* is operable to add charge to the gate terminal of MP1 when the first comparator 701*a* indicates (on node 705*a*) that output supply Vout is greater than the first reference voltage "Vref+d2." As the voltage of the gate terminal MP1 increases because of the added charge by the charge pump 702*a*, MP1 sources less current to Vout causing Vout to fall below "Vref+d2" or be substantially close to "Vref+d2."

In one embodiment, second comparator 701*b* causes the second charge pump 702*b*, from the plurality of charge pumps, to increase drive strength of the output stage 703 when the output supply Vout is less than the second reference voltage "Vref+d1." In such an embodiment, when the output stage comprises a p-type transistor MP1, the second charge pump 702*b* is operable to subtract charge from the gate terminal of MP1 when the second comparator 701*b* indicates (on node 705*b*) that output supply Vout is less than the second reference voltage "Vref+d1." As the voltage of the gate terminal MP1 decreases because of the subtracted charge by the charge pump 702*b*, MP1 sources more current to Vout causing Vout to rise above "Vref+d1" or be substantially close to "Vref+d1."

In one embodiment, logic unit 701 comprises a third comparator 701*c* to cause a third charge pump 702*c*, from the plurality of charge pumps, to reduce drive strength of the output stage 703 when the output supply Vout is greater than the third reference voltage "Vref." One technical effect of the third comparator 701*c* and the third charge pump 702*c* is to provide a boost to the output supply Vout when Vout undershoots below the third reference level "Vref." In such an embodiment, when the output stage comprises a p-type transistor MP1, the third charge pump 702*c* is operable to subtract charge from the gate terminal of MP1 when the third comparator 701*c* indicates (on node 705*c*) that output supply Vout is less than the third reference voltage "Vref." As the voltage of the gate terminal MP1 decreases because of the subtracted charge by the charge pump 702*c*, MP1 sources more current to Vout causing Vout to rise above "Vref" or be substantially close to "Vref." In one embodiment, second comparator 701*b* and the second charge pump 702*b* continue to provide charge to Vout to bring Vout substantially close to "Vref+d1."

In one embodiment, logic unit 701 comprises: a fourth comparator 701*d* to cause the fourth charge pump 702*d*, from the plurality of charge pumps, to increase drive strength of the output stage 703 when the output supply Vout is less than the fourth reference voltage "Vref+d3." One technical effect of the fourth comparator 701*d* and the fourth charge pump 702*d* is to squelch the output supply Vout when Vout overshoots above the fourth reference level "Vref+d3." In such an embodiment, when the output stage 703 comprises a p-type transistor MP1, the fourth charge pump 702*d* is operable to add charge to the gate terminal of MP1 when the fourth comparator 701*d* indicates (on node 705*d*) that output supply Vout is greater than the fourth reference voltage "Vref+d3." As the voltage of the gate terminal MP1 increases because of the added charge by the fourth charge pump 702*d*, MP1 sources less current to Vout causing Vout to fall below "Vref+d3" or be substantially close to "Vref+d3." In one embodiment, first comparator 701*a* and the first charge pump 702*a* continue to reduce Vout to bring Vout substantially close to "Vref+d2."

While the embodiment of FIG. 7 shows that the outputs of the charge pumps 702*a-d* are shorted together and coupled to the same gate terminal of MP1, in one embodiment the outputs of each charge pump are coupled to different output stage drivers. In one embodiment, the charge pumps have different driving strengths.

For example, third and fourth charge pumps 702*c* and 702*d* may have higher charging/discharging strengths compared to the first and second charge pumps 702*a* and 702*b* for fast boost from undershoot of Vout and fast squelch of overshoot of Vout. In such an embodiment, third and fourth comparators 701*c* and 701*d* and third and fourth charge pumps 702*c* and 702*d* provide the hysteresis function of hysteresis unit 203 of FIG. 2. In one embodiment, pre-driver transistors (not shown) of the output stage 703 are used for providing extra current path from Vin to Vout during an undershoot event on Vout, where the pre-driver transistors are controlled by third charge pump 702*c*.

In one embodiment, plurality of charge pumps 702*a-d* is implemented as circuits shown in FIG. 3A. In other embodiments, other implementations of the charge pumps 702*a-d* may be used.

Referring back to FIG. 7, in one embodiment comparators 701*a-d* are clock gated comparators. In such an embodiment, Vout is updated according to a speed of a clock signal used by the clock gated comparators. In one embodiment, additional combinational logic is coupled to the comparators 701*a-d* to control when to turn on or off the comparators and/or charge pumps to control the strength of the output stage. In other embodiments, any form of comparators may be used.

Figure 8:
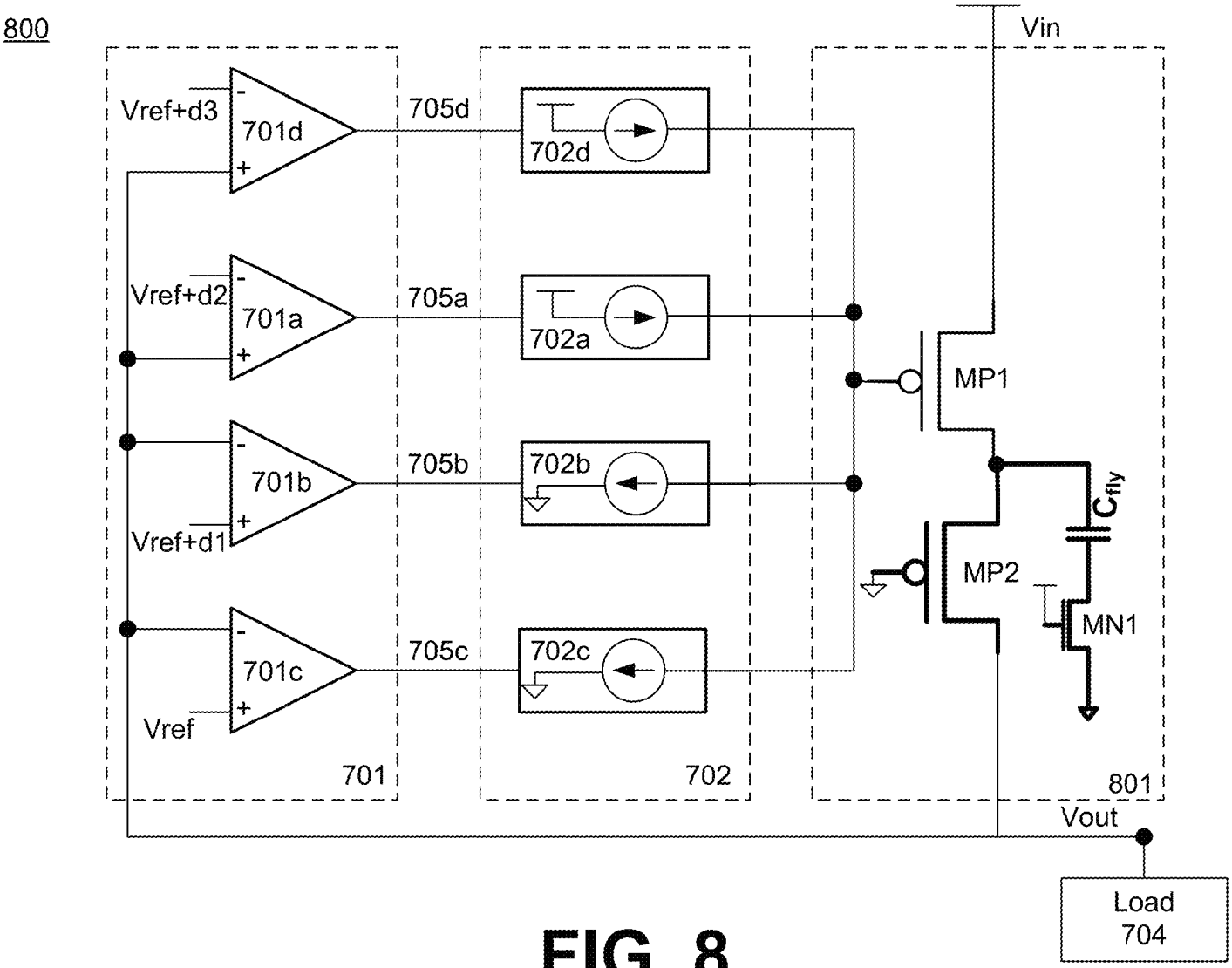
FIG. 8 is an embedded LDO in an SCVR operating in LDO mode, according to another embodiment of the disclosure.

FIG. 8 is an embedded LDO in an SCVR 800 operating in LDO mode, according to another embodiment of the disclosure. The embodiment of FIG. 8 is similar to FIG. 7 except that the output stage is reconfigured to convert an SCVR into an LDO. Accordingly, transistors MP2 and MN1 are turned on.

In one embodiment, MP3 is turned off, converting the SCVR similar to FIG. 5A to an integrated LDO stage. In this embodiment, the additional series resistance of MP2 is added to the LDO output stage compared to the embodiment of FIG. 7. One technical effect of the additional series resistance is to reduce the maximum output current for identical device sizes compared to the embodiment of FIG. 7. In one embodiment, an additional output filter comprising the resistances of MN1 and MP2 and the capacitance Cfly is available in the embedded LDO in the SCVR 800. In such an embodiment, the additional filter improves output droop response of the LDO utilizing the available SCVR capacitance by turning on MN1.

Figure 9:
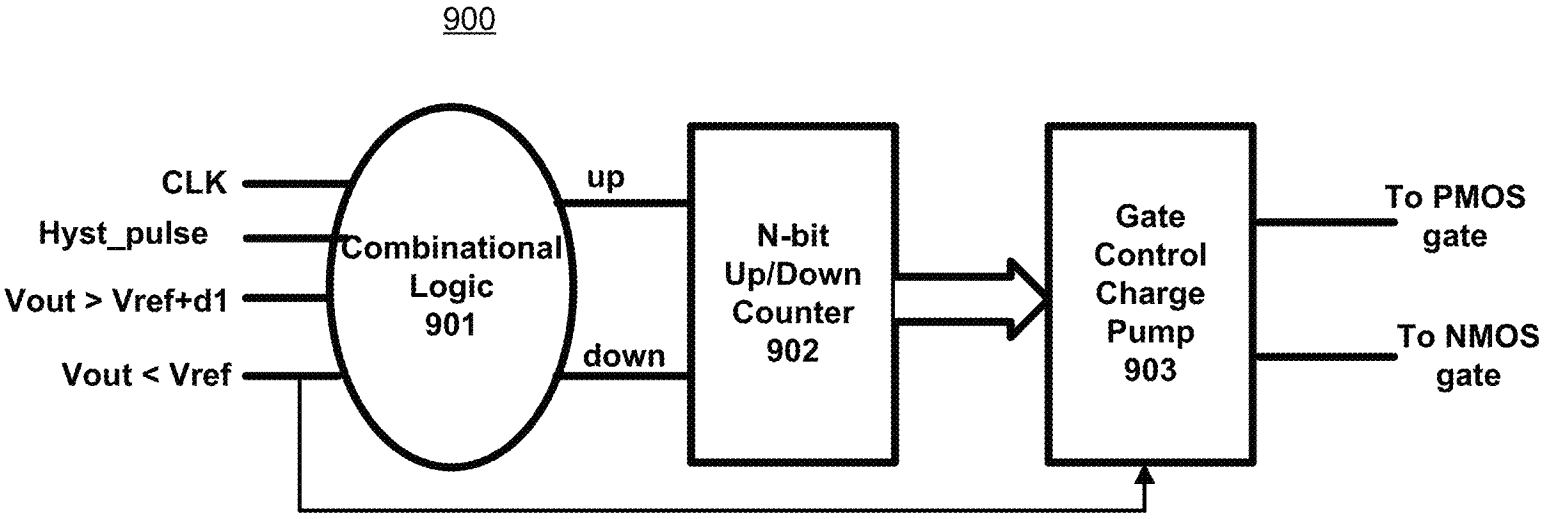
FIG. 9 is logic for controlling the output stage of the LDO of FIG. 7, according to one embodiment of the disclosure.

FIG. 9 is logic 900 for controlling the output stage 703 of the LDO of FIG. 7, according to one embodiment of the disclosure. In one embodiment, logic 900 comprises combinational logic 901, an 'N' bit counter 902, and control logic 903 to control the gate of the charge pumps 702*a-d*.

In one embodiment, combinational logic 901 comprises the comparators 701*a-d* and other logic that determine whether Vout is above or below "Vref," "Vref+d1," "Vref+d2," and "Vref+d3." In one embodiment, the combinational logic 901 is reduced to the comparators of FIG. 8. In another embodiment, counter 902 determines the strength of the charge pump 903 to improve stability and response time of the LDO with different load and PVT (process, temperature and voltage) conditions. In one embodiment, for low load currents, the counter 902 changes its count in one direction whereas for relatively higher load currents the counter 902 changes its count in the opposite direction. In such an embodiment, the actual direction of count of the counter 902 depends on the transistors of the charge pump 903 and is not limiting to the scope of the disclosure. In another embodiment, counter 902 may be controlled depending on a variety of input and load conditions without change in design.

In one embodiment, the charge pump 903 is fixed in strength with reference to FIG. 8. In another embodiment, the strength of the charge pump 903 is controlled by the counter 902 and can charge or discharge the gate of MP1 at a different rate. In one embodiment, the strength of the charge pump 903 may be changed in a linear fashion. In one embodiment, the strength of the charge pump 903 may be changed in a binary-weighted fashion. In another embodiment, the strength of the charge pump 903 may be a deterministic non-linear or an arbitrary function of the value of the controller 902's output.

Figure 10:
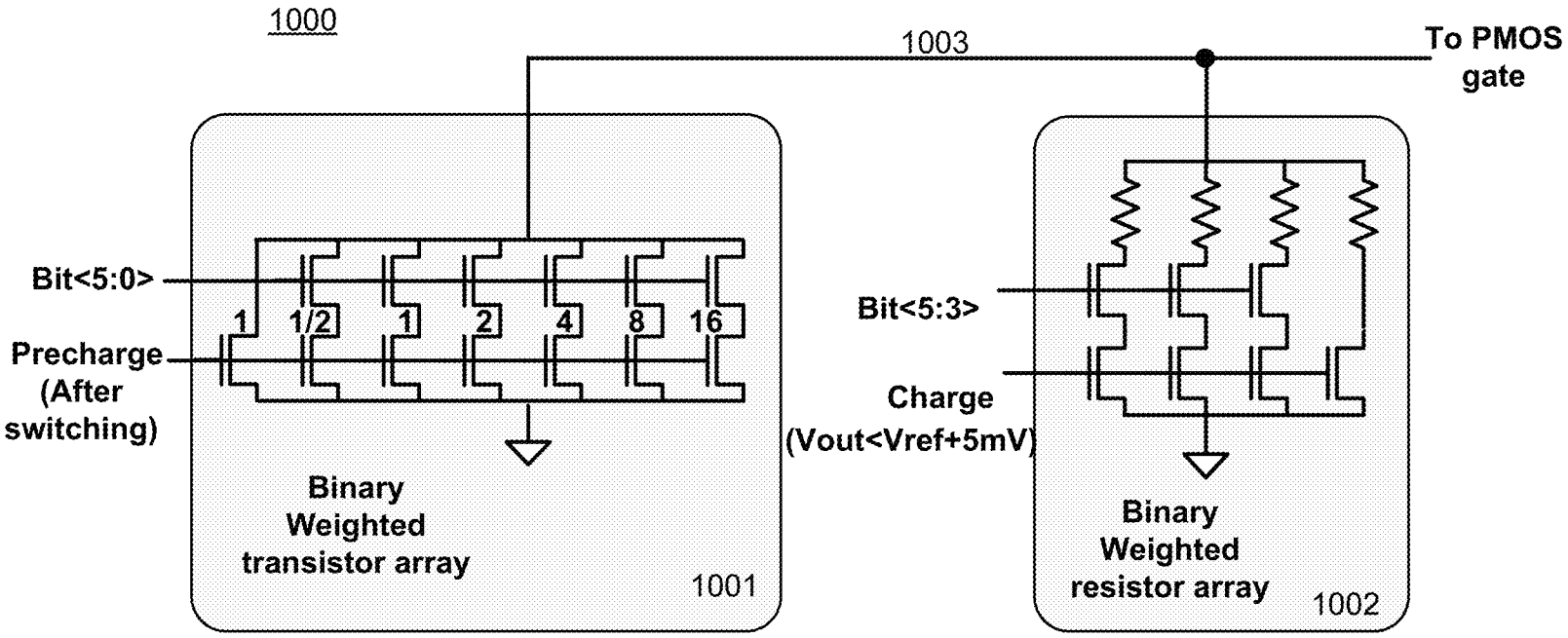
FIG. 10 is a charge pump of the LDO of FIG. 7, according to one embodiment of the disclosure.

FIG. 10 is a charge pump 1000 of the LDO of FIG. 7, according to one embodiment of the disclosure. In one embodiment, charge pump 1000 comprises a weighted transistor array 1001 and a weighted resistor array 1002. In one embodiment, weighted transistor array 1001 comprises n-type transistors coupled together as shown. In one embodiment, weighted transistor array 1001 is binary weighted. In other embodiments, other weighting techniques may be used. For example, thermometer weighting technique may be used.

In one embodiment, resistor array 1002 comprises transistors like the transistors of 1001 but with additional series resistors as shown. In one embodiment, resistor array 1002 and the transistor array 1001 are coupled together at node 1003 which is input to the gate terminal of MP1 of the output stage 703. In one embodiment, the transistors and resistors may be weighted in a linear or any arbitrary function of the input bits<5:0>, where "<5:0>" indicates a 6-bit bus. In one embodiment, the charge pump 1001 is the charge pump 702*c* of FIG. 7 while the charge pump 1002 is the charge pump 702*b* of FIG. 7. In one embodiment, charge pumps 702*a* and 702*d* are complementary to charge pumps 702*b* and 702*c*. In one embodiment, the charge pumps 702-*d* may have different strengths/sizes.

Figure 11:
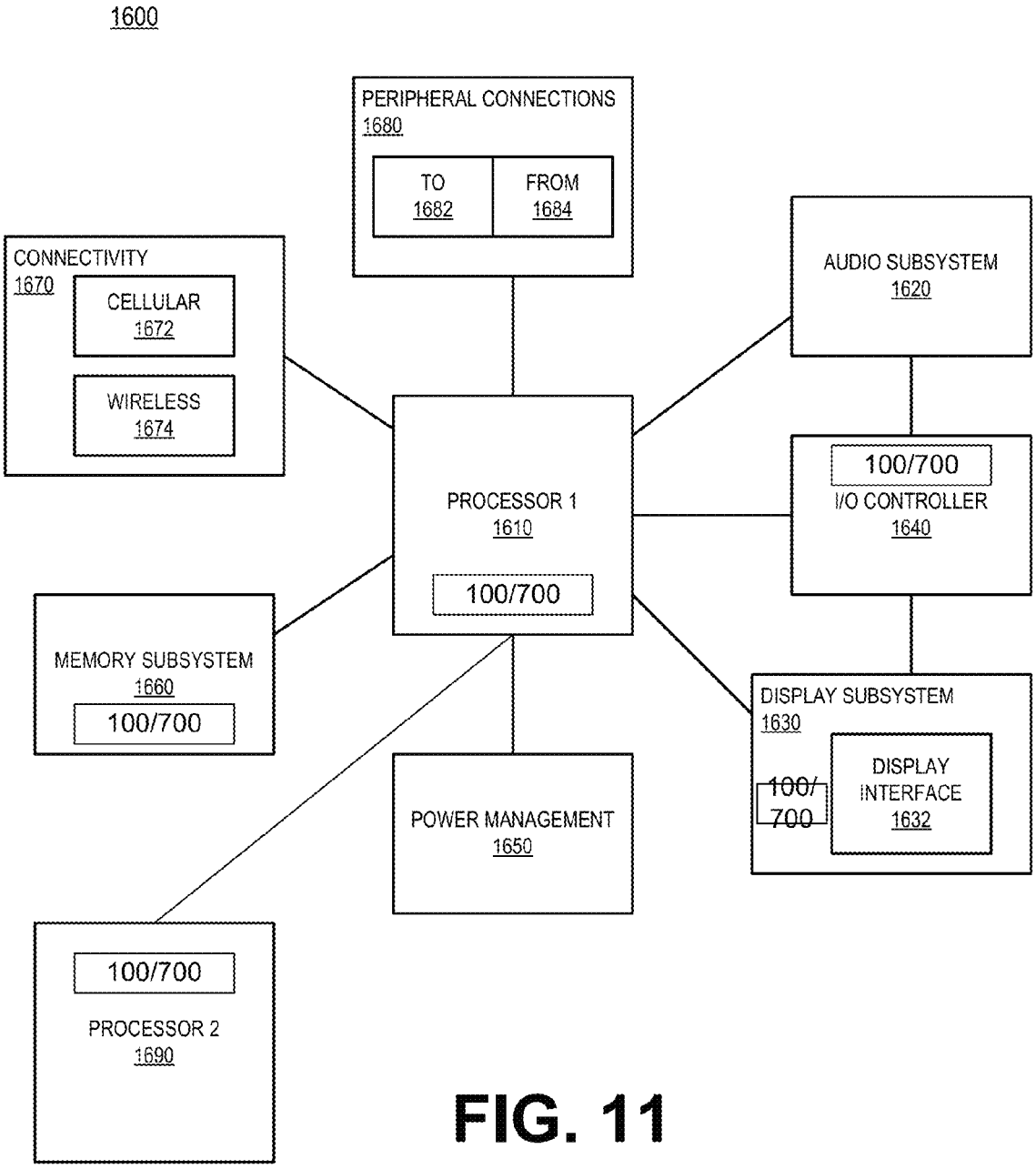
FIG. 11 is a system-level diagram of a smart device comprising a processor with the LDO regulator, according to one embodiment of the disclosure.

FIG. 11 is a system-level diagram of a smart device 1600 comprising a processor with the LDO regulator, according to one embodiment of the disclosure. FIG. 11 also illustrates a block diagram of an embodiment of a mobile device in which flat surface interface connectors could be used. In one embodiment, computing device 1600 represents a mobile computing device, such as a computing tablet, a mobile phone or smart-phone, a wireless-enabled e-reader, or other wireless mobile device. It will be understood that certain components are shown generally, and not all components of such a device are shown in device 1600.

In one embodiment, computing device 1600 includes a first processor 1610 with the digitally phase locked LDO (e.g., 100, 200, 600, 700, 800) and a second processor 1690 with the digitally phase locked LDO (e.g., 100, 200, 600, 700, 800), according to the embodiments discussed herein. The various embodiments of the present disclosure may also comprise a network interface within 1670 such as a wireless interface so that a system embodiment may be incorporated into a wireless device, for example, cell phone or personal digital assistant.

In one embodiment, processor 1610 can include one or more physical devices, such as microprocessors, application processors, microcontrollers, programmable logic devices, or other processing means. The processing operations performed by processor 1610 include the execution of an operating platform or operating system on which applications and/or device functions are executed. The processing operations include operations related to I/O (input/output) with a human user or with other devices, operations related to power management, and/or operations related to connecting the computing device 1600 to another device. The processing operations may also include operations related to audio I/O and/or display I/O.

In one embodiment, computing device 1600 includes audio subsystem 1620, which represents hardware (e.g., audio hardware and audio circuits) and software (e.g., drivers, codecs) components associated with providing audio functions to the computing device. Audio functions can include speaker and/or headphone output, as well as microphone input. Devices for such functions can be integrated into device 1600, or connected to the computing device 1600. In one embodiment, a user interacts with the computing device 1600 by providing audio commands that are received and processed by processor 1610.

Display subsystem 1630 represents hardware (e.g., display devices) and software (e.g., drivers) components that provide a visual and/or tactile display for a user to interact with the computing device. Display subsystem 1630 includes display interface 1632, which includes the particular screen or hardware device used to provide a display to a user. In one embodiment, display interface 1632 includes logic separate from processor 1610 to perform at least some processing related to the display. In one embodiment, display subsystem 1630 includes a touch screen (or touch pad) device that provides both output and input to a user.

I/O controller 1640 represents hardware devices and software components related to interaction with a user. I/O controller 1640 is operable to manage hardware that is part of audio subsystem 1620 and/or display subsystem 1630. Additionally, I/O controller 1640 illustrates a connection point for additional devices that connect to device 1600 through which a user might interact with the system. For example, devices that can be attached to the computing device 1600 might include microphone devices, speaker or stereo systems, video systems or other display device, keyboard or keypad devices, or other I/O devices for use with specific applications such as card readers or other devices.

As mentioned above, I/O controller 1640 can interact with audio subsystem 1620 and/or display subsystem 1630. For example, input through a microphone or other audio device can provide input or commands for one or more applications or functions of the computing device 1600. Additionally, audio output can be provided instead of, or in addition to display output. In another example, if display subsystem includes a touch screen, the display device also acts as an input device, which can be at least partially managed by I/O controller 1640. There can also be additional buttons or switches on the computing device 1600 to provide I/O functions managed by I/O controller 1640.

In one embodiment, I/O controller 1640 manages devices such as accelerometers, cameras, light sensors or other environmental sensors, or other hardware that can be included in the computing device 1600. The input can be part of direct user interaction, as well as providing environmental input to the system to influence its operations (such as filtering for noise, adjusting displays for brightness detection, applying a flash for a camera, or other features).

In one embodiment, computing device 1600 includes power management 1650 that manages battery power usage, charging of the battery, and features related to power saving operation. Memory subsystem 1660 includes memory devices for storing information in device 1600. Memory can include nonvolatile (state does not change if power to the memory device is interrupted) and/or volatile (state is indeterminate if power to the memory device is interrupted) memory devices. Memory 1660 can store application data, user data, music, photos, documents, or other data, as well as system data (whether long-term or temporary) related to the execution of the applications and functions of the computing device 1600.

Elements of embodiments are also provided as a machine-readable medium (e.g., memory 1660) for storing the computer-executable instructions (e.g., instructions to implement any other processes discussed herein). The machine-readable medium (e.g., memory 1660) may include, but is not limited to, flash memory, optical disks, CD-ROMs, DVD ROMs, RAMs, EPROMs, EEPROMs, magnetic or optical cards, or other type of machine-readable media suitable for storing electronic or computer-executable instructions. For example, embodiments of the disclosure may be downloaded as a computer program (e.g., BIOS) which may be transferred from a remote computer (e.g., a server) to a requesting computer (e.g., a client) by way of data signals via a communication link (e.g., a modem or network connection).

Connectivity 1670 includes hardware devices (e.g., wireless and/or wired connectors and communication hardware) and software components (e.g., drivers, protocol stacks) to enable the computing device 1600 to communicate with external devices. The device 1600 could be separate devices, such as other computing devices, wireless access points or base stations, as well as peripherals such as headsets, printers, or other devices.

Connectivity 1670 can include multiple different types of connectivity. To generalize, the computing device 1600 is illustrated with cellular connectivity 1672 and wireless connectivity 1674. Cellular connectivity 1672 refers generally to cellular network connectivity provided by wireless carriers, such as provided via GSM (global system for mobile communications) or variations or derivatives, CDMA (code division multiple access) or variations or derivatives, TDM (time division multiplexing) or variations or derivatives, or other cellular service standards. Wireless connectivity 1674 refers to wireless connectivity that is not cellular, and can include personal area networks (such as Bluetooth, Near Field, etc), local area networks (such as Wi-Fi), and/or wide area networks (such as WiMax), or other wireless communication.

Peripheral connections 1680 include hardware interfaces and connectors, as well as software components (e.g., drivers, protocol stacks) to make peripheral connections. It will be understood that the computing device 1600 could both be a peripheral device ("to" 1682) to other computing devices, as well as have peripheral devices ("from" 1684) connected to it. The computing device 1600 commonly has a "docking" connector to connect to other computing devices for purposes such as managing (e.g., downloading and/or uploading, changing, synchronizing) content on device 1600. Additionally, a docking connector can allow device 1600 to connect to certain peripherals that allow the computing device 1600 to control content output, for example, to audiovisual or other systems.

In addition to a proprietary docking connector or other proprietary connection hardware, the computing device 1600 can make peripheral connections 1680 via common or standards-based connectors. Common types can include a Universal Serial Bus (USB) connector (which can include any of a number of different hardware interfaces), DisplayPort including MiniDisplayPort (MDP), High Definition Multimedia Interface (HDMI), Firewire, or other type.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may," "might," or "could" be included, that particular component, feature, structure, or characteristic is not required to be included. If the specification or claim refers to "a" or "an" element, that does not mean there is only one of the elements. If the specification or claims refer to "an additional" element, that does not preclude there being more than one of the additional element.

Furthermore, the particular features, structures, functions, or characteristics may be combined in any suitable manner in one or more embodiments. For example, a first embodiment may be combined with a second embodiment anywhere the particular features, structures, functions, or characteristics associated with the two embodiments are not mutually exclusive.

While the disclosure has been described in conjunction with specific embodiments thereof, many alternatives, modifications and variations of such embodiments will be apparent to those of ordinary skill in the art in light of the foregoing description. The embodiments of the disclosure are intended to embrace all such alternatives, modifications, and variations as to fall within the broad scope of the appended claims.

In addition, well known power/ground connections to integrated circuit (IC) chips and other components may or may not be shown within the presented figures, for simplicity of illustration and discussion, and so as not to obscure the disclosure. Further, arrangements may be shown in block diagram form in order to avoid obscuring the disclosure, and also in view of the fact that specifics with respect to implementation of such block diagram arrangements are highly dependent upon the platform within which the present disclosure is to be implemented i.e., such specifics should be well within purview of one skilled in the art. Where specific details (e.g., circuits) are set forth in order to describe example embodiments of the disclosure, it should be apparent to one skilled in the art that the disclosure can be practiced without, or with variation of, these specific details. The description is thus to be regarded as illustrative instead of limiting.

The following examples pertain to further embodiments. Specifics in the examples may be used anywhere in one or more embodiments. All optional features of the apparatus described herein may also be implemented with respect to a method or process.

For example, in one embodiment, the apparatus comprises: an output stage having an input supply node to receive an input power supply and an output node to provide an output supply to a load; an amplifier to control current strength of the output stage according to the output supply and a reference voltage; and a hysteresis unit to monitor the output supply and operable to control the current strength of the output stage according to a voltage level of the output supply.

In one embodiment, the output stage comprises: a first stage coupled to the amplifier; and a second stage operable to be selectively turned on or off by the hysteresis unit. In one embodiment, the first and second stages are normally on. In one embodiment, the second stage is operable to be turned off when the output supply overshoots. In one embodiment, the output stage comprises: a third stage operable to be selectively turned on or off by the hysteresis unit. In one embodiment, the third stage is normally off. In one embodiment, the third stage is operable to be turned on when the output supply undershoots. In one embodiment, the first, second, and third stages comprise first, second, and third p-type transistors respectively coupled between the input supply node and the output node.

In one embodiment, the hysteresis unit comprises: a first comparator to compare the output supply relative to a first reference, the first comparator to generate a first output to control current strength of the second stage, wherein the first reference is different from the reference voltage. In one embodiment, the hysteresis unit comprises: a second comparator to compare the output supply relative to a second reference, the second comparator to generate a second output to control current strength of the third stage, wherein the second reference is different from the reference voltage.

In one embodiment, the apparatus further comprises: a bias circuit coupled to the third stage, the bias circuit to adjust current strength of the third stage. In one embodiment, the bias circuit to generate a charging current for adjusting current strength of the third stage, wherein the bias circuit is operable to adjust the charging current according to the reference voltage. In one embodiment, the bias circuit comprises a replica regulator.

In one embodiment, the apparatus further comprises: a charge pump coupled to an output of the amplifier, the charge pump operable to adjust a voltage level of the output of the amplifier. In one embodiment, the charge pump to add charge to the output of the amplifier when the output supply overshoots. In one embodiment, the charge pump to subtract charge from the output of the amplifier when the output supply undershoots.

In one embodiment, a system comprises a memory (e.g., DRAM, SRAM, flash, MROM, etc); a processor, coupled to the memory, the processor including a low dropout regulator according to the apparatus discussed herein; and a wireless interface to communicatively couple the processor with another device. In one embodiment, the system further comprises a display unit.

In one embodiment, the apparatus comprises: an output stage having an input supply node to receive an input power supply and an output node to provide an output supply to a load; a plurality of charge pumps to adjust current strength of the output stage; and a logic unit to monitor the output supply and operable to control the plurality of charge pumps according to a voltage level of the output supply and one or more reference voltages.

In one embodiment, the logic unit comprises: a first comparator to cause a first charge pump, from the plurality of charge pumps, to reduce drive strength of the output stage when the output supply is greater than a first reference voltage. In one embodiment, the logic unit comprises: a second comparator to cause a second charge pump, from the plurality of charge pumps, to increase drive strength of the output stage when the output supply is less than a second reference voltage. In one embodiment, the logic unit comprises: a third comparator to cause a third charge pump, from the plurality of charge pumps, to reduce drive strength of the output stage when the output supply is greater than a third reference voltage. In one embodiment, the logic unit comprises: a fourth comparator to cause a fourth charge pump, from the plurality of charge pumps, to increase drive strength of the output stage when the output supply is less than a fourth reference voltage.

In one embodiment, the apparatus further comprises: a reference generator to generate the first, second, third, and fourth reference voltages. In one embodiment, the fourth reference is higher than the first, second, and third voltage references. In one embodiment, the third reference is lower than the first, second, and fourth voltage references. In one embodiment, the first reference is higher than the second and third voltage references.

In one embodiment, the output stage comprises a p-type transistor with a gate terminal coupled directly or indirectly to the plurality of charge pumps, a source terminal coupled directly or indirectly to the input supply node, and a drain terminal coupled directly or indirectly to the output node. In one embodiment, the one or more charge pumps from the plurality of charge pumps are operable to have different charging strengths.

An abstract is provided that will allow the reader to ascertain the nature and gist of the technical disclosure. The abstract is submitted with the understanding that it will not be used to limit the scope or meaning of the claims. The following claims are hereby incorporated into the detailed description, with each claim standing on its own as a separate embodiment.

We claim:

1. An apparatus comprising:

an output stage comprising an input supply node to receive an input power supply, a multiplexer comprising a first input coupled to the input supply node, a second input, a select input and an output; and an output node coupled to output of the multiplexer to provide an output supply to a load;

an amplifier coupled to the second input of the multiplexer to control the output stage according to the output supply and a reference voltage;

and a circuit to monitor the output supply coupled to the select input of the multiplexer that is operable to provide a digital control of the output stage according to a voltage level of the output supply.

2. The apparatus of claim 1, wherein the output stage comprises:

a first stage coupled to the amplifier; and a second stage operable to be selectively turned on or off by the circuit.

3. The apparatus of claim 2, wherein the first and second stages are normally on.

4. The apparatus of claim 2, wherein the second stage is operable to be turned off when the output supply overshoots.

5. The apparatus of claim 2, wherein the output stage comprises:

a third stage operable to be selectively turned on or off by the circuit.

6. The apparatus of claim 5, wherein the third stage is normally off.

7. The apparatus of claim 6, wherein the third stage is operable to be turned on when the output supply undershoots.

8. The apparatus of claim 5, wherein the first, second, and third stages comprise first, second, and third p-type transistors respectively coupled between the input supply node and the output node.

9. The apparatus of claim 5, wherein the circuit comprises:

a second comparator to compare the output supply relative to a second reference, the second comparator to generate a second output to control an electric current strength of the third stage, wherein the second reference is different from the reference voltage.

10. The apparatus of claim 5 further comprises:

a bias circuit coupled to the third stage, the bias circuit configured to adjust an electric current strength of the third stage.

11. The apparatus of claim 10, wherein the bias circuit is configured to generate a charging current for adjusting an electric current strength of the third stage, wherein the bias circuit is operable to adjust the charging current according to the reference voltage.

12. The apparatus of claim 10, wherein the bias circuit comprises a replica regulator.

13. The apparatus of claim 2, wherein the circuit comprises:

a first comparator to compare the output supply relative to a first reference, the first comparator to generate a first output to control an electric current strength of the second stage, wherein the first reference is different from the reference voltage.

14. The apparatus of claim 1 further comprises:

a charge pump coupled to an output of the amplifier, the charge pump operable to adjust a voltage level of the output of the amplifier.

15. The apparatus of claim 14, wherein the charge pump is configured to add charge to the output of the amplifier when the output supply overshoots.

16. The apparatus of claim 14, wherein the charge pump is configured to subtract charge from the output of the amplifier when the output supply undershoots.

17. A system comprising:

a memory;

a processor, coupled to the memory, the processor comprising a low dropout regulator comprising:

an output stage comprising an input supply node to receive an input power supply, a multiplexer comprising a first input coupled to the input supply node, a second input, a select input and an output, and an output node coupled to the output of the multiplexer to provide an output supply to a load;

an amplifier coupled to the second input of the multiplexer to control the output stage according to the output supply and a reference voltage; and a circuit to monitor the output supply coupled to the select input of the multiplexer that is operable to provide a digital control of the output stage according to a voltage level of the output supply; and a wireless interface to communicatively couple the processor with another device.

18. The system of claim 17 further comprises a display unit.

19. An apparatus comprising:

an output stage comprising an input supply node to receive an input power supply and an output node to provide an output supply to a load;

a plurality of charge pumps comprising a first charge pump and a second charge pump to adjust the output stage, wherein the first charge pump is to reduce a drive strength of the output stage when the output supply is greater than a first reference voltage and the second charge pump is to increase the drive strength of the output stage when the output supply is less than a second reference voltage; and a logic unit comprising a counter to monitor the output supply and operable to provide a digital control of the plurality of charge pumps according to a voltage level of the output supply and one or more reference voltages.

20. The apparatus of claim 19, wherein the logic unit comprises:

a first comparator to cause a first charge pump, from the plurality of charge pumps, to reduce drive strength of the output stage when the output supply is greater than a first reference voltage.

21. The apparatus of claim 20, wherein the logic unit comprises:

a second comparator to cause a second charge pump, from the plurality of charge pumps, to increase drive strength of the output stage when the output supply is less than a second reference voltage.

22. The apparatus of claim 21, wherein the logic unit comprises:

a third comparator to cause a third charge pump, from the plurality of charge pumps, to reduce drive strength of the output stage when the output supply is greater than a third reference voltage.

23. The apparatus of claim 22, wherein the logic unit comprises:

a fourth comparator to cause a fourth charge pump, from the plurality of charge pumps, to increase drive strength of the output stage when the output supply is less than a fourth reference voltage.

24. The apparatus of claim 23 further comprises:

a reference generator to generate the first, second, third, and fourth reference voltages.

25. The apparatus of claim 23, wherein fourth reference is higher than the first, second, and third voltage references.

26. The apparatus of claim 23, wherein the third reference is lower than the first, second, and fourth voltage references.

27. The apparatus of claim 23, wherein the first reference is higher than the second and third voltage references.

28. The apparatus of claim 19, wherein the output stage comprises a p-type transistor with a gate terminal coupled directly or indirectly to the plurality of charge pumps, a source terminal coupled directly or indirectly to the input supply node, and a drain terminal coupled directly or indirectly to the output node.

29. The apparatus of claim 19, wherein one or more charge pumps from the plurality of charge pumps are operable to have different charging strengths.

* * * * *